US005710959A

United States Patent [19]

Hirooka et al.

[11] Patent Number: 5,710,959

[45] Date of Patent: Jan. 20, 1998

[54] IMAGE FORMING APPARATUS HAVING A FUNCTION OF TURNING ON A POWER SUPPLY USING A TIMER

[75] Inventors: Kazuhiko Hirooka, Tokyo; Yoshihiro Funamizu, Kawasaki; Akihiko Satoh, Kawasaki; Mitsuhiko Sato, Kawasaki; Tetsuya Nozaki, Yokohama; Yoshihito Osari, Kawasaki; Hajime Kaji, Zushi, all of Japan

[73] Assignee: Canon Kabushiki Kaisha, Tokyo, Japan

[21] Appl. No.: 629,465

[22] Filed: Apr. 10, 1996

[30] Foreign Application Priority Data

Apr. 25, 1995 [JP] Japan ..... 7-102431

[51] Int. Cl.[6] ..... G03G 15/00

[52] U.S. Cl. ..... 399/88; 399/90

[58] Field of Search ..... 399/88, 90, 38, 399/75, 81; 355/200, 204, 208, 210; 364/480, 492; 323/271, 282, 904

[56] References Cited

U.S. PATENT DOCUMENTS 3,669,412 6/1972 Ogawa .
4,436,408 3/1984 Inuzuka et al. .
5,325,209 6/1994 Manabe .
5,457,516 10/1995 Kim .
5,483,464 1/1996 Song ..... 364/492

*Primary Examiner*—Sandra L. Brase
*Attorney, Agent, or Firm*—Fitzpatrick, Cella, Harper & Scinto

[57] ABSTRACT

An image forming apparatus having a timer function includes a main switch for manually switching between supply and interruption of electric power to the apparatus, a detector for detecting whether the main switch is in a power-interruption state or in a power-supply state, a memory for storing a state indicating that the main switch is in a power-interruption state when it has been detected that the main switch is in a power-interruption state, a controller for placing the apparatus in a standby state in which an image can be formed or in a shutdown state in which an image cannot be formed during a preset time period, and a power supply for supplying power to the controller, wherein the apparatus is placed in a standby state even by a set shutdown time period in the case a power-interruption state is stored and wherein the apparatus is placed in a shutdown state during the set shutdown time period in the case the power-interruption state is not stored.

9 Claims, 8 Drawing Sheets

IMAGE FORMING APPARATUS HAVING A FUNCTION OF TURNING ON A POWER SUPPLY USING A TIMER

BACKGROUND OF THE INVENTION

1. Field of the Invention

This invention relates to an image forming apparatus which can automatically turn on a power supply at a desired preset time, 2. Description of the Related Art Electrophotographic copiers are examples of image forming apparatuses which have a timer function. By setting on-off times for each day of the week, such as automatically turning on a copier at an opening hour at every morning and turning off the copier at a closing hour, the function of automatically providing turning-on (standby)/turning-off (shutdown) states for the copier at predetermined times without switching on/off an power-supply switch by the user is realized.

When setting a weekly timer for operation, the power-supply switch is always switched on. In a state in which the copier is in a shutdown state according to the weekly timer, a minimum amount of power is supplied to a control circuit and the like, and power supply to other circuits is interrupted.

When the power-supply switch is switched off and then switched on by the user in a shutdown state of the copier set by the weekly timer, the shutdown state is released even at a period set in the shutdown state by the weekly timer, so that a copyable standby state is provided.

In the above-described conventional approach, in an office or the like where a commercial power supply is disconnected on a main switchboard after work, when, for example, the commercial power supply is switched off and then swtiched on or recovers from service interrption during a shutdown state of the copier set by the weekly timer, the shutdown state of the copier is released and the copier enters a standby state. As a result, unnecessary electric power is consumed.

If, in order to solve the above-described problems, the apparatus is arranged such that the shutdown state is not released by switching-off and then switching-on operations by the user during a time period set in the shutdown state by the weekly timer, it is necessary to perform a key operation or the like for releasing the shutdown state in order to start the copier. Accordingly, a great burden is placed on the user to release the copier from timer's shutdown period.

SUMMARY OF THE INVENTION

It is an object of the present invention to provide an image forming apparatus which removes the above-described disadvantages.

It is another object of the present invention to provide an image forming apparatus capable of turning on/off a power supply by a timer function, in which useless power consumption is minimized.

It is still another object of the present invention to provide an image forming apparatus capable of turning on/off a power supply by a timer function, in which the operability when the power supply is turned on during a turned-off period is improved.

According to one aspect, the present invention which achieves these objectives relates to an image forming apparatus comprising a main switch for manually switching between supply and interruption of power for the apparatus, detection means for detecting whether the main switch is in a power interruption state or in a power supply state, non-volatile storage means for storing that the main switch is in a power interruption state when the detection means has detected that the main switch is in the power interruption state, control means for making the apparatus in a standby state in which an image can be formed or in a shutdown state in which an image cannot be formed, during a preset time period, and supply means for supplying the control means with electric power. The control means makes the apparatus in a standby state even during a set shutdown time period if the storage means stores a power interruption state when the supply means has supplied the control means with electric power. The control means makes the apparatus in a shutdown state during the set shutdown time period if the storage means does not store a power interruption state when the supply means has supplied the control means with electric power.

According to another aspect, the present invention which achieves these objectives relates to an image forming apparatus comprising input means for inputting a commercial power supply, a manually operated main switch for switching on or off the power supply of the apparatus, and control means for making the apparatus in a standby state in which an image can be formed or in a shutdowns state in which an image cannot be formed, during a preset time zone. The control means makes the apparatus in a standby state when the main switch has changed from an off-state to an on-state during a set shutdown time zone. The control means makes the apparatus in a shutdown state when the commercial power supply has changed from a non-input state to an input state a state with respect to the input means during the set shutdown time zone.

According to still another aspect, the present invention which achieves these objectives relates to a start control method in an image forming apparatus comprising a main switch for manually switching between supply and interruption of power for the apparatus, detection means for detecting whether the main switch is in a power interruption state or in a power supply state, nonvolatile storage means for storing that the main switch is in a power interruption state when the detection means has detected that the main switch is in the power interruption state, control means for making the apparatus in a standby state in which an image can be formed or in a shutdown state in which an image cannot be formed during a preset time period, and supply means for supplying the control means with electric power. The method comprises the steps of determining if the storage means stores a power interruption state when the supply means has supplied the control means with electric power, and making the apparatus in a standby state even during a set shutdown period when it has been determined that the storage means stores a power interruption state and making the apparatus in a shutdown state during the set shutdown period when it has been determined that the storage means does not store a power interruption state.

The foregoing and other objects, advantages and features of the present invention will become more apparent from the following detailed description of the preferred embodiment taken in conjunction with the accompanying drawings.

DETAILED DESCRIPTION OF THE PREFERRED EMBODIMENT

A preferred embodiment of the present invention will now be described with reference to the drawings.

Figure 1:
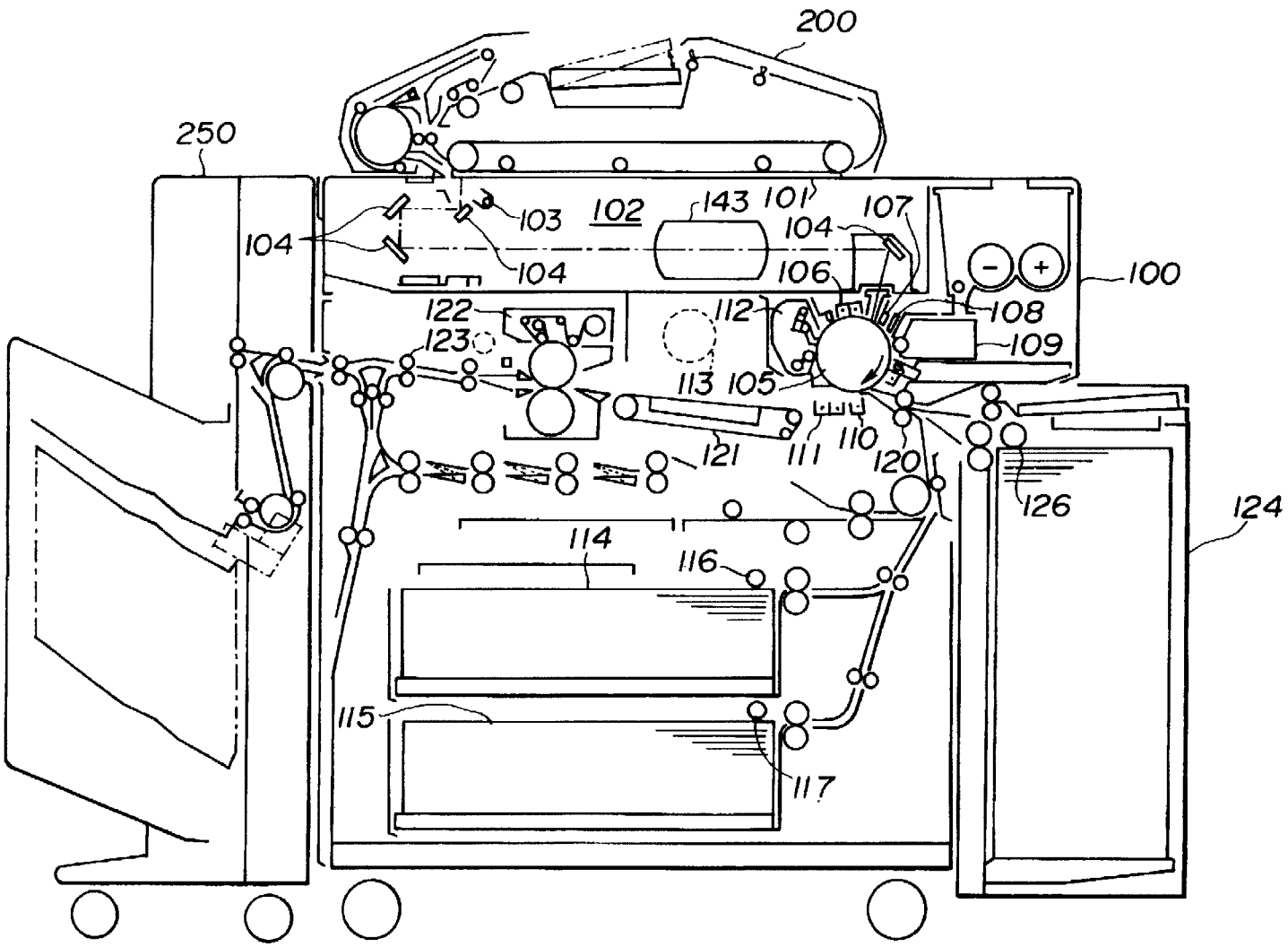
FIG. 1 is a cross-sectional view illustrating the configuration of an image forming apparatus according to a first embodiment of the present invention.

FIG. 1 is a cross-sectional view illustrating the configuration of an image forming apparatus according to the preferred embodiment.

In FIG. 1, reference numeral 100 represents the main body of a copier, reference numeral 200 represents a recycling automatic original (document) feeder (hereinafter termed an "RDF"), and reference numeral 250 represents a sorter. The RDF 200 and the sorter 250 can be freely combined with the main body 100.

Original-mount glass 101 serves as an original mount. An optical system 102 comprises an original-illuminating lamp (exposure lamp) 103, scanning mirrors 104, a lens 143, a motor and the like. The exposure lamp 103 illuminates an original, and reflected light from the original is projected onto a photosensitive drum 105 via the scanning mirrors 104 and the lens 143.

A primary charger 106, a blank exposure unit 107, a potential sensor 108, a developing unit 109, a transfer charger 110, a separation charger 111 and a cleaning device 112 are disposed around the photosensitive drum 105.

The photosensitive drum 106 is rotated in the direction of the arrow shown in FIG. 1 by a main motor 113. The surface of the photosensitive drum 105 is subjected to corona discharge by the primary charger 106. When the reflected light from the original is projected onto the photosensitive drum 105, an electrostatic latent image is formed on the surface of the photosensitive drum 105. The electrostatic latent image is visualized as a toner image by being developed by the developing unit 109.

Transfer paper is fed from a sheet-feeding deck 124, an upper cassette 114 or a lower cassette 115 into the main body 100 via pickup rollers 126, 116 or 117, respectively. The leading edge of the transfer paper is adjusted by registration rollers 120 so as to coincide with the leading edge of the toner image. The transfer paper is fed to the photosensitive drum 105, and the toner image is transferred onto the transfer paper by the transfer charger 110. Then, the transfer paper is separated from the photosensitive drum 105 by the separation charger 111, and is guided to a fixing unit 122 by a conveying belt 121. The toner image on the transfer paper is fixed by pressure and heat in the fixing unit 122, and the transfer paper having the fixed toner image is discharged outside the main body 100 by discharging rollers 123. The surface of the photosensitive drum 105 is cleaned by the cleaning device FIG. 2 is a plan view illustrating the configuration of a principal portion of an operation unit 800 provided in the main body 100 shown in FIG. 1.

Figure 2:
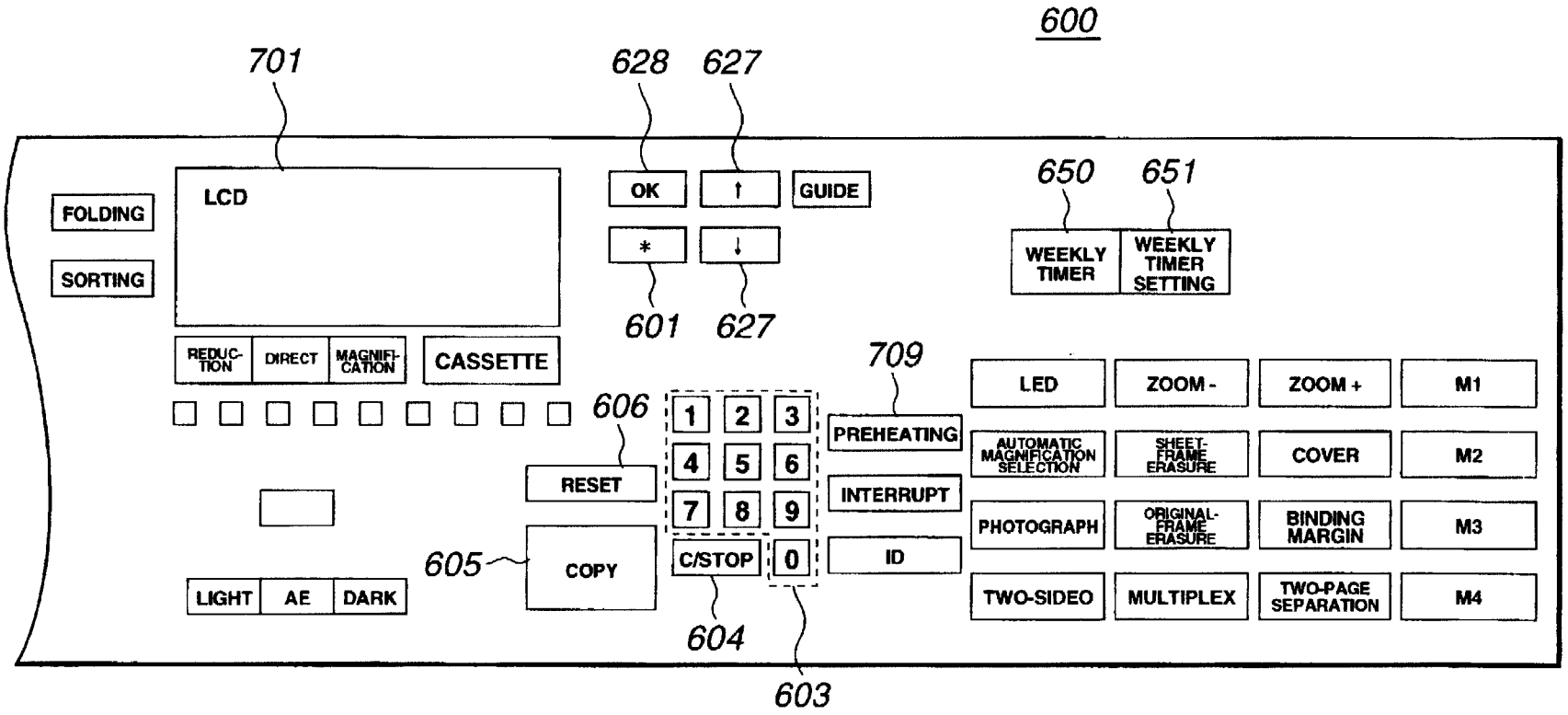
FIG. 2 is a plan view illustrating a principal portion of an operation unit of the image forming apparatus shown in FIG. 1.

In FIG. 2, a weekly-timer key 650 is used when setting/releasing the operation of a weekly timer. A weekly-timer setting key 651 is used as a settling key when setting an operation time of the weekly timer.

An asterisk (*) key 601 is used when the operator sets the amount of a binding margin, or in a setting mode, such as setting of the size of original-frame erasure or the like. Cursor keys 627 are used when selecting a setting item in a setting mode. An OK key 628 is used when setting the contents of a setting mode. An all-reset key 608 is depressed when returning the mode to a standard mode.

The key 608 is also depressed when returning the mode to the standard mode from an automatic shutoff state. A copy start key 808 is depressed when starting a copying operation. A clear/stop key 804 has the function of a clear key during a standby state, and the function of a stop key during a copying operation. The clear key is also used when releasing the set number of copies. The stop key is depressed when interrupting a continuous copying operation.

Copying processing is stopped after a copying operation when the stop key has been depressed has ended. A ten-digit keypad 603 is depressed when setting the number of copies or the time of a timer, as well as when setting an * (asterisk) mode. Memory keys M1 through M4 can register modes which are frequently used by the user.

Reference numeral 701 represents an LCD (liquid-crystal display)-type message display for displaying information relating to a copying operation, which displays characters and drawings in the format of 96×192 dots. For example, the message display 701 displays the time of the weekly timer set through the weekly-timer setting key 681, the number of copies and the time of the timer set through the ten-digit keypad 603, and the contents of setting of various modes.

Figure 8:
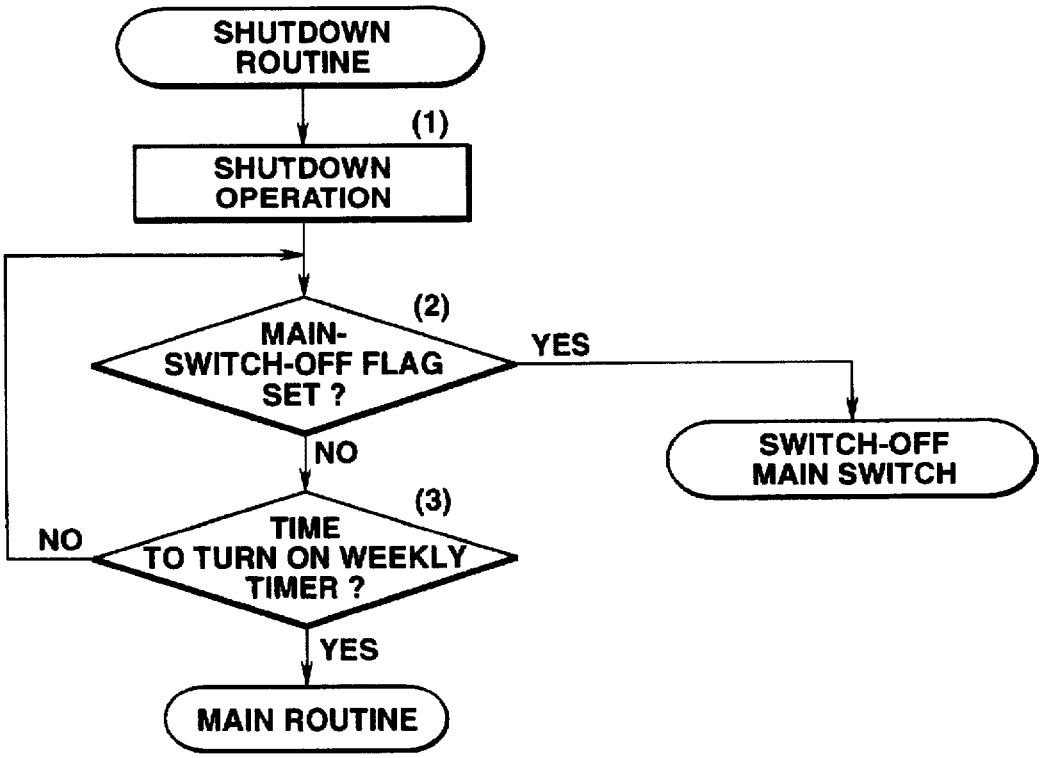
FIG. 8 is a flowchart illustrating detalied procedures of a shutdown processing routine according to a weekly timer.

FIG. 8 is a block diagram illustrating the configuration of control of the image forming apparatus shown in FIG. 1. In FIG. 8, the same reference numerals are provided for the same components as those shown in FIG. 1.

Figure 3:
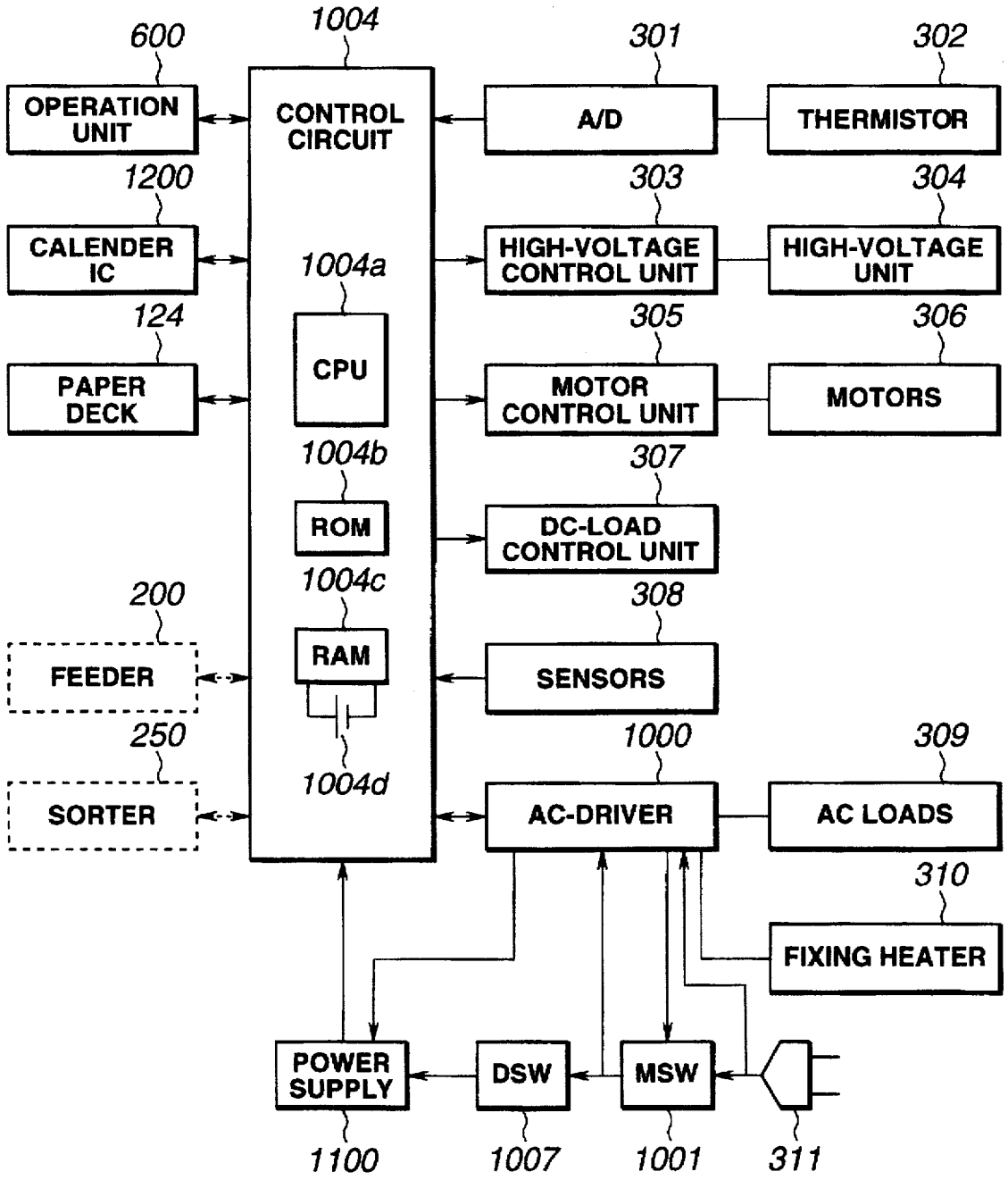
FIG. 3 is a block diagram illustrating the configuration of control of the image forming apparatus shown in FIG. 1.

In FIG. 3, a control circuit (controller) 1004 comprises a CPU (central processing unit) **1004*a*, a ROM (read-only memory) 1004*b*, a RAM (random access memory) 1004*c*, and the like, and controls the entire copying sequence based on programs stored in the ROM 1004*b*. A battery 1004*d* maintains the contents of the RAM 1004*c* even when electric power supply from a power supply 1100** is interrupted.

As described above, a key input unit, comprising keys for setting various kinds of copying modes (a simplex mode, a duplex mode, a multiplex mode, copying magnification, selection of a cassette, and the like), the ten-digit key pad for setting the number of copies, the time of the timer, and the like, the stark key for instructing start of a copying operation, the stop key for instructing stop of a copying operation, the reset key for returning the operation mode to the standard state, the key for setting the weekly timer and the like, and a display unit, comprising LED's, an LCD or the like, for displaying the operation-mode setting state or the like, are disposed on the operation unit 600.

A thermistor 302 detects the surface temperature of a fixing roller 144, and the detection value subjected to A/D (analog-to-digital) conversion by an A/D converter 301 is input to the controller 1004. The surface temperature of the fixing roller 144 is controlled to a predetermined value by the controller 1004 based on the detection value of the thermistor 302.

A high-voltage control unit 303 controls a high-voltage unit 304 for applying respective predetermined potentials to a charging system, comprising the primary charger 106, the transfer charger 110 and the like, the developing unit 109, and the like. A motor control unit 305 controls the drive of motors 306, such as various kinds of stepping motors, a main driving motor and the like.

A DC-load control unit 307 controls the drive of solenoids for the pickup roller 116 and the like, clutches for the registration rollers 120 and the like, fans and the like.

Sensors 308 comprise a sensor for detecting a jam of paper, and the like. The outputs of the sensors 308 are input to the controller 1004.

An AC driver 1000 controls AC power supply for AC loads 309, such as the original-illuminating lamp 103 and the like, and a fixing heater 310. The AC driver 1000 also detects abnormality in the original-illuminating lamp 103, the fixing heater 310 and the like, and makes a main switch 1001 having a shutoff function in an off-state.

As will be described later, AC lines before and after the main switch 1001 are switched by the control of the controller 1004, and are input to a power supply 1100. AC electric power from the AC driver 1000 is input to the power supply 1100, which supplies DC electric power to the controller 1004 and the like. AC electric power is also input from an input power supply receptacle 311 to the power supply 1100 via the main switch 1001 and a door switch 1007.

Reference numeral 1200 represents a calendar IC (integrated circuit) for controlling time, which is driven by a battery 1201.

Figure 4:
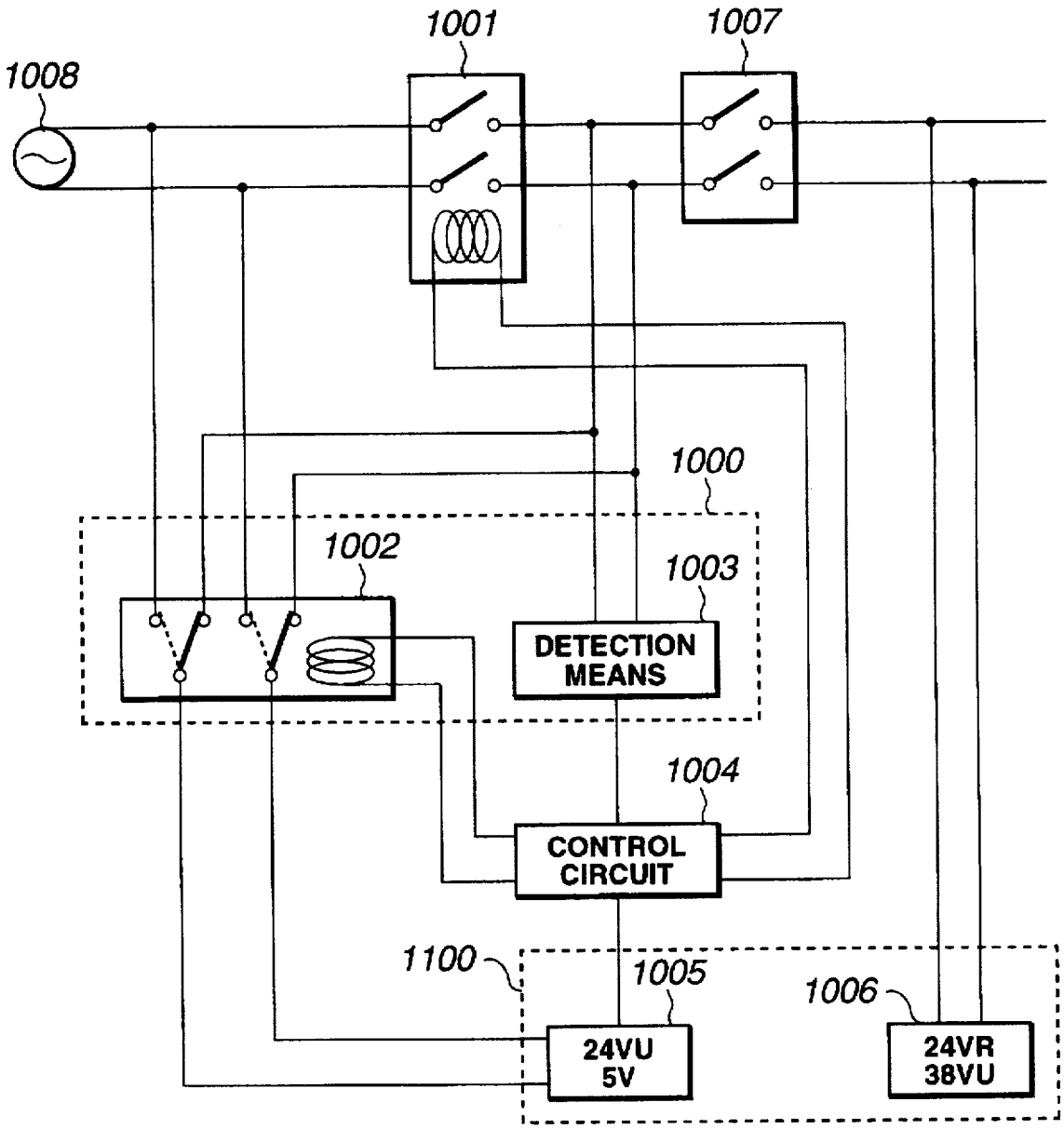
FIG. 4 is a block diagram illustrating the configuration of circuitry of a power supply unit.

FIG. 4 is a block diagram illustrating the configuration of circuitry of the power supply unit shown in FIG. 3. In FIG. 4, the same components as those shown in FIG. 3 are indicated by the same reference numerals.

In FIG. 4, the main switch 1001 serves as switching means for switching between supply and interruption of electric power. A relay 1002 serves as power-supply maintenance means for maintaining electric power supply to the control circuit 1004 even if the main switch 1001 is switched to a power interruption state. Detection means 1003 detects the switching operation of the main switch 1001. The control circuit (controller) 1004 controls switching of the relay 1002 in accordance with the state of the main switch 1001. The power supply 1100 grossly comprises DC power supplies 1008 and 1006. The DC power supply 1005 comprises a 5 V (volt) stabilized power supply, serving as a control-system power supply for driving the control circuit 1004 and the like, and a 24 V power supply for driving clutches, solenoids and the like, The DC power supply 1006 comprises a 24 V stabilized power supply for analog signals requiring high voltages and accuracy, and a 38 V power supply for the main motor and the motor for the optical system. The DC power supply 1005 is generated from AC electric power input via the relay 1002, and the DC power supply 1006 is generated from AC electric power input via the main switch 1001 and the door switch 1007.

Next, the operation of the relay 1002 shown in FIG. 4 will be described.

The relay 1002 is connected to sides indicated by solid lines in FIG. 4 when the control circuit 1004 is in a non-control state. When the main switch 1001 is switched on, the electric power of a commercial power supply 1008 is supplied to the power supply 1005 via the main switch 1001 and the relay 1002. The 5 V power supply thereby starts to operate to start the operation of the control circuit 1004. Upon the start of the operation, the control circuit 1004 causes current to flow in the coil of the relay 1002, which is switched to sides indicated by broken lines. When the relay 1002 is switched to the sides indicated by the broken lines, the electric power of the commercial power supply 1008 can be supplied to the power supply 1005 irrespective of the state of the main switch 1001, so that electric power can be supplied to the control circuit 1004.

The control circuit 1004 disconnects supply of the electric power of the commercial power supply 1008 to the power supply 1005 by interrupting the flow of the current in the coil of the relay 1002 whenever necessary, and electric power supply to the control circuit 1004 is also disconnected. Thereafter, when the main switch 1001 is switched on, the operation of the control circuit 1004 is resumed.

A description will now be provided of a power-supply control method of the image forming apparatus of the present embodiment with reference to FIGS. 5 through 9.

Figure 5:
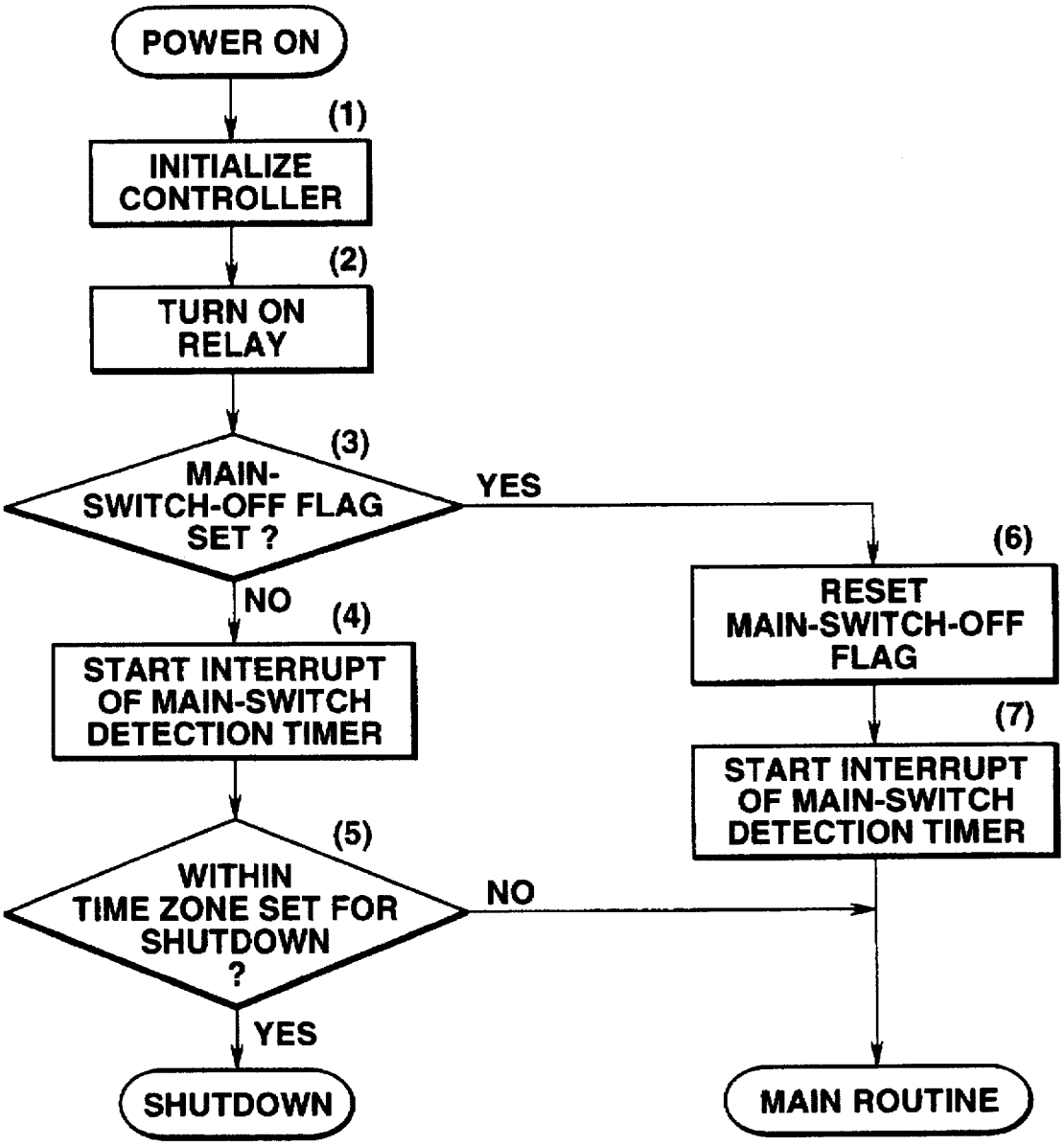
FIG. 5 is a flowchart illustrating an example of power-on processing procedures of the image forming apparatus shown in FIG. 1.

FIG. 5 is a flowchart illustrating an example of power-on processing procedures of the image forming apparatus of the present embodiment. In FIG. 8, numerals (1)–(7) indicate respective steps.

When electric power is supplied to the controller 1004 (power on), initialization of the controller 1004, such as clearing of work areas of the RAM 1004*c*, setting of an I/O port, and the like, is performed (1). Then, the relay 1002 is switched to the sides indicated by the broken lines in FIG. 4 by passing current in the coil of the relay 1002 (2).

Then, it is determined if a main-switch-off flag indicating that the main switch 1001 is switched off is stored (set) in a backed-up region of the RAM 1004*c* (3). If the result of the determination is negative, interrupt of the timer in a main-switch-detection routine (to be descibed later) is started (4).

Then, it is determined if the current time is within a time zone set for shutdown by the weekly timer by referring to the calendar IC 1200 (5). If the result of the determination is affirmative, the process proceeds to a shutdown routine (to be described later).

If the result of the determination in step (5) is negative, the process proceeds to a main routine (to be described later).

If the result of the determination in step (3) is affirmative, a main-switch-off flag is reset (8), interrupt of the timer in the main-switch-detection routine is started (7), and the process proceeds to the main routine.

Figure 6:
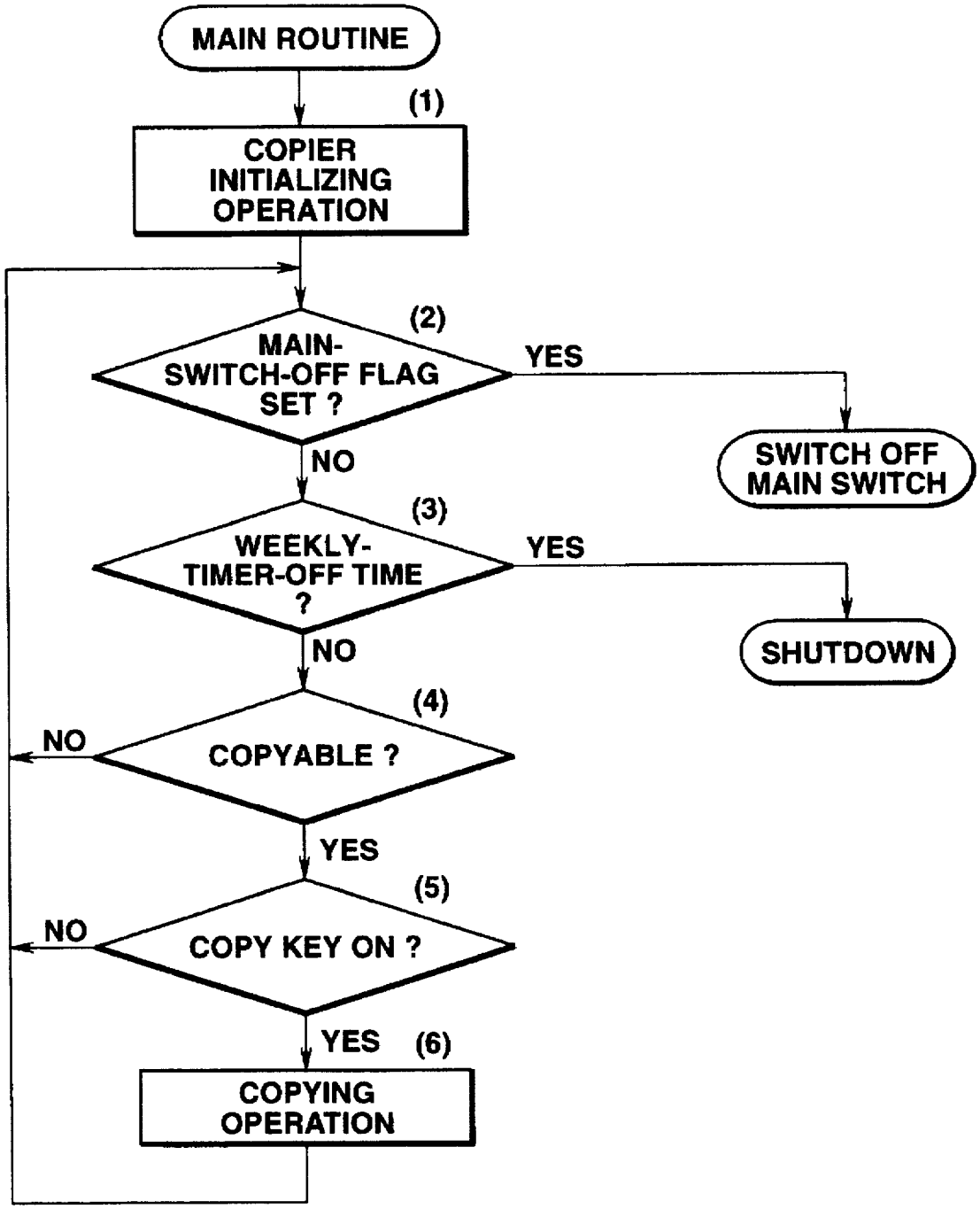
FIG. 6 is a flowchart illustrating detailed procedures of a main routine in the image forming apparatus shown in FIG. 1.

FIG. 6 is a flowchart illustrating detailed procedures of the main routine in the image forming apparatus of the present embodiment. In FIG. 6, numerals (1)–(6) represent respective steps.

After starting initializing operations necessary to start the copier 100, such as start of the temperature control of the fixing heater 310, a cleaning operation of the photosensitive drum 105, and the like (1), it is determined if a main-switch-off flag is set (2). If the result of the determination is affirmative, the process proceeds to a main-switch-off routine.

If the result of the determination in step (2) is negative, it is then determined if the current time reaches an off-time of the weekly timer by referring to the calendar IC 1200 (3). If the result of the determination is affirmative, the process proceeds to the shutdown routine.

If the result of the determination in step (3) is negative, it is then determined if a copyable state (completion of the temperature control of the fixing heater 310, presence of copying paper, and the like) is provided (4). If the result of the determination is affirmative and the copy start key 805 has been depressed (5), a copying operation is started (6). After completing the copying operation, the process returns to step (2).

Although not shown in FIG. 6, it is determined during execution of steps (1) and (6) if a main-switch-off flag is set. If the result of the determination is affirmative, the process proceeds to the main-switch-off routine.

Figure 7:
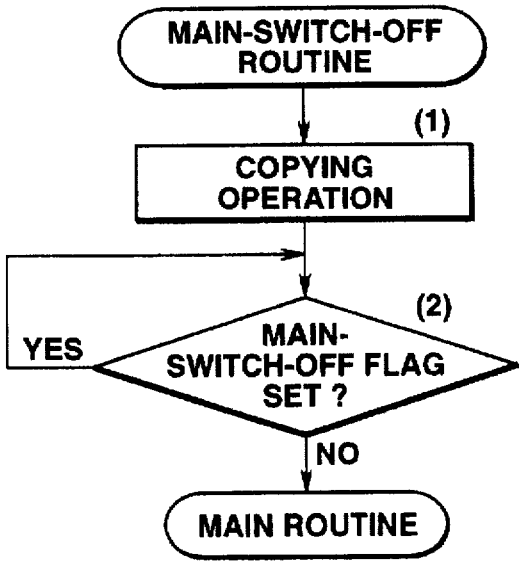
FIG. 7 is a flowchart illustrating detailed procedures of a main-switch-off routine.

FIG. 7 is a flowchart illustrating detailed procedures of the main-switch-off routine shown in FIG. 6. In FIG. 7, numerals (1) and (2) represent respective steps.

After performing shutdown operations, such as turning off the power supply to respective loads and the like (1), it is determined if a main-switch-off flag is set (2). If the result of the determination is negative, the process proceeds to the main routine.

FIG. 8 is a flowchart illustrating detailed procedures of the shutdown processing routine according to the weekly timer. In FIG. 8, numerals (1)–(3) represent respective steps.

After performing shutdown operations, such as turning off of the fixing heater 310, and the like (1), it is determined if a mains-switch-off flag is set (2). If the result of the determination is affirmative, the process proceeds to the main-switch-off routine.

If the result of the determination in step (2) is negative, it is then determined if the current time reaches an on-time of the weekly timer by referring to the calendar IC 1200 (3). If the result of the determination is affirmative, the process proceeds to the main routine.

If the result of the determination in step (3) is negative, the process returns to step (2), and the steps (2) and (3) are repeated.

Figure 9:
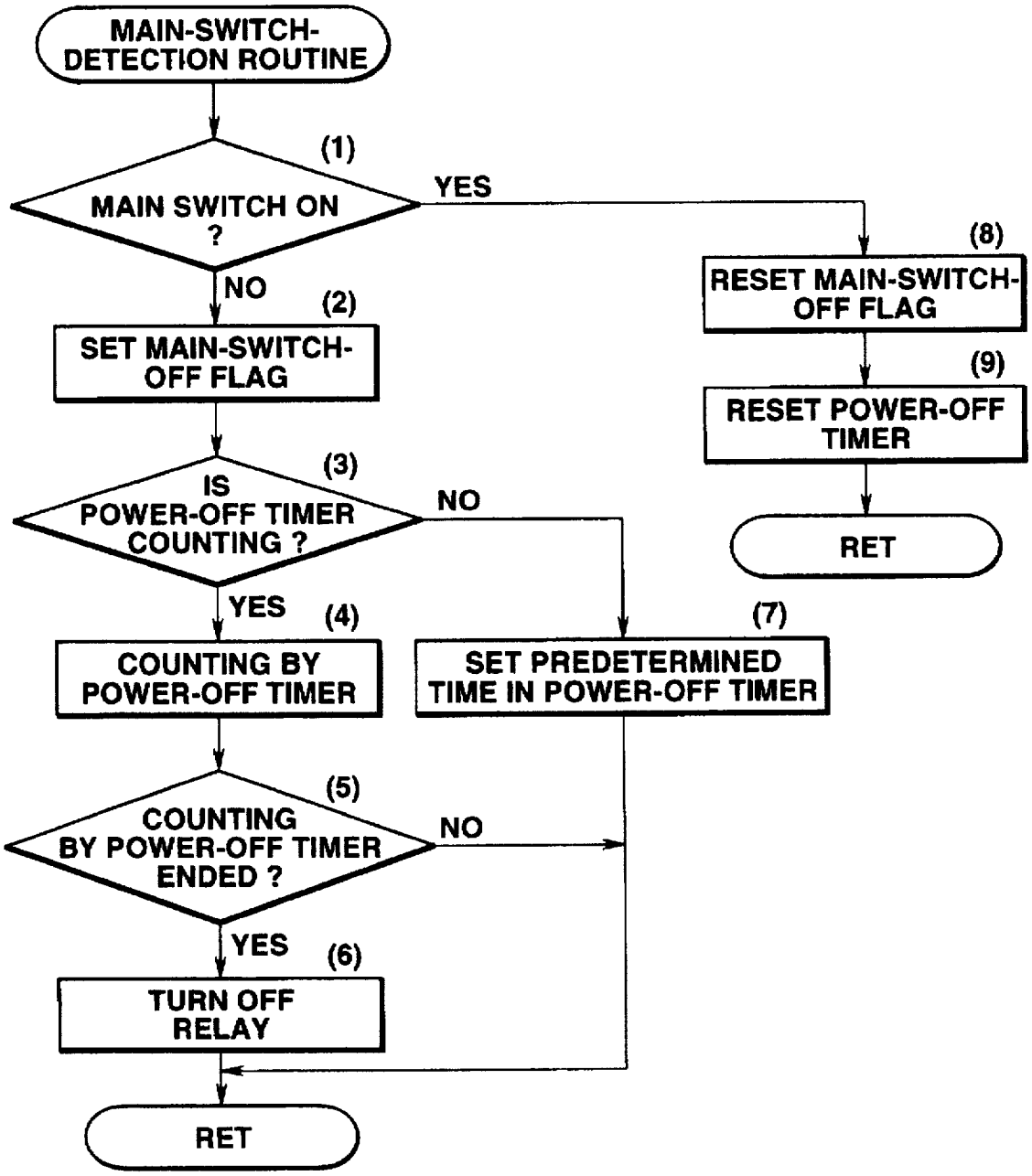
FIG. 9 is a flowchart illustrating main-switch-detection-timer interrupt processing procedures in the image forming apparatus shown in FIG. 1.

FIG. 9 is a flowchart illustrating processing procedures of the main-switch-detection routine in the image forming apparatus of the present embodiment. In FIG. 9, numerals (1)–(9) represent respective steps. In the present embodiment, the state of the main switch is detected using an interval timer, which provides interrupt at every 2 msec, in the course of the operations shown in FIGS. 5–8.

First, it is determined if the main switch is switched on by referring to the detection means 1003 of the main switch (1). If the result of the determination is affirmative, a mains-switch-off flag indicating that the main switch is in an off-state is reset (8), a power-off timer (to be described later) is reset (9), and the process is terminated.

If the result of the determination in step (1) is negative, a main-switch-off flag is set (2). It is then determined if a power-off timer for completely turning off the copier after a predetermined time period is performing a counting operation (3). If the result of the determination is negative, the predetermined time period is set in the power-off timer and a counting state is provided (7), and the process is terminated.

If the result of the determination in step (3) is affirmative, the counting operation of the power-off timer is continued (4), and it is determined if the counting operation of the power-off timer has been completed (5). If the result of the determination in step (5) is affirmative, power supply for the coil of the relay 1002 is turned off to connect the relay 1002 to the sides indicated by the solid lines shown in FIG. 1 (6), and thereby to disconnect electric power supply to the copier, and the process is terminated.

That is, if a power-supply-off state (a main-switch-off flag) is stored in the RAM 1004*c* when starting the image forming apparatus, it is determined that the main switch 1001 is switched on. Hence, the image forming apparatus is turned on to be in a standby state in which an image can be formed, irrespective of the time set in the weekly timer. If a power-supply-off state is not stored in the RAM 1004*c* when starting the image forming apparatus, it is determined that the apparatus has returned from an off-state or service interruption of the commercial power supply. Hence, the image forming apparatus is made in a shutdown state during a time zone in which the apparatus is set to be in a shutdown state according to the time set in the weekly time. Accordingly, the start of the main body of the image forming apparatus is switched by checking if a power supply on/off state has been effected while the weekly timer is operational, for example, by return from service interruption or by an operation of the main switch by the user. As a result, unnecessary electric power consumption can be reduced.

When the main switch 1001 has been detected to be in a power-supply-off state when the image forming apparatus has been set in a shutdown state by the weekly timer, the RAM 1004*c* stores the power-supply-off state (main-switch-off flag), and electric power supply for the image forming apparatus is completely disconnected after a predetermined time period. Hence, electric power consumption in a time zone in which a power-supply-off state is stored and a shut-down state is provided can be minimized.

The individual components shown in outline or designated by blocks in the drawings are all well known in the image forming apparatus arts and their specific construction and operation are not critical to the operation or the best mode for carrying out the invention.

While the present invention has been described with respect to what is presently considered to be the preferred embodiment, it is to be understood that the invention is not limited to the disclosed embodiment. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

a main switch for manually switching between supply and interruption of electric power to said apparatus;

detection means for detecting whether said main switch is in a power-interruption state or in a power-supply state;

nonvolatile storage means for storing a state which indicates that said main switch is in a power-interruption state when said detection means detects that said main switch is in the power interruption state;

control means for placing said apparatus in a standby state in which an image can be formed or in a shutdown state in which an image cannot be formed, during a preset time period; and supply means for supplying said control means with electric power, wherein said control means places said apparatus in a standby state even during a set shutdown time period in the case said storage means stores a power-interruption state when said supply means has supplied said control means with electric power, and wherein said control means places said apparatus in a shutdown state during the set shutdown time period in the case said storage means does not store a power-interruption state when said supply means has supplied said control means with electric power.

2. An image forming apparatus according to claim 1, wherein when said control means places said image forming apparatus in a standby state, said storage means resets a state in storage indicating that said main switch is in a power interruption state.

3. An image forming apparatus according to claim 1, wherein when said detection means has detected that said main switch is in a power-interruption state, said control means controls said supply means so as to interrupt power supply to said control means.

4. An image forming apparatus according to claim 1, wherein said control means controls said supply means so as to supply said control means with electric power even if said image forming apparatus is in a shutdown state.

5. An image forming apparatus comprising:

a plug for inputting electric power to said apparatus from a source external to said apparatus;

a manually operated main switch for switching on or off the electric power input by said plug to said apparatus; and control means for placing said apparatus in a standby state in which an image can be formed or in a shutdown state in which an image cannot be formed, during a preset time zone, wherein said control means places said apparatus in a standby state when said main switch has changed from an off-state to an on-state during a set shutdown time zone, and wherein said control means places said apparatus in a shut-down state when the electric power input by said plug to said apparatus has changed from a non-input state to an input state during the set shutdown time zone.

6. An image forming apparatus according to claim 5, further comprising supply means, connected to said plug and said main switch, for supplying said control means with electric power, wherein when electric power is supplied from said supply means to said control means by switching on said main switch, said control means makes said image forming apparatus in a standby state, and wherein when electric power is supplied from said supply means to said control means by inputting electric power by said plug, said control means makes said image forming apparatus in a shutdown state.

7. An image forming apparatus according to claim 6, wherein when said main switch is in an off-state, said control means controls said supply means so as not to supply said control means with electric power.

8. A start control method in an image forming apparatus comprising a main switch for manually switching between supply and interruption of electric power to the apparatus, detection means for detecting whether the main switch is in a power-interruption state or in a power-supply state, non-volatile storage means for storing that the main switch is in a power-interruption state when the detection means has detected that the main switch is in the power-interruption state, control means for placing the apparatus in a standby state in which an image can be formed or in a shutdown state in which an image cannot be formed, during a preset time period, and supply means for supplying the control means with electric power, said method comprising the steps of:

determining if the storage means stores a state indicating that a power-interruption state has been set when the supply means has supplied the control means with electric power; and placing the apparatus in a standby state even during a set shutdown time period when it has been determined that the storage means stores a power-interruption state, and placing the apparatus in a shutdown state during the set shutdown time period when it has been determined that the storage means does not store a power-interruption state.

9. A starting control method in an image forming apparatus comprising a plug for inputting electric power to said apparatus from a source external to said apparatus, a manually operated main switch for switching on or off the electric power input by said plug to said apparatus, and control means for placing said apparatus in a standby state in which an image can be formed or in a shutdown state in which an image cannot be formed, during a preset time zone, said method comprising steps of:

detecting whether said main switch has changed from an off-state to an on-state during a set shutdown time zone;

detecting whether the electric power by said plug to said apparatus has changed from a non-input state to an input state during the set shutdown time zone;

placing said apparatus in a standby state when said main switch has changed from an off-state to an on-state during the set shutdown time zone; and placing said apparatus in a shut-down state when the electric power by said plug to said apparatus has changed from a non-input state to an input state during the set shutdown time zone.

* * * * *